US007326865B2

(12) United States Patent
Østergaard

(10) Patent No.: US 7,326,865 B2
(45) Date of Patent: Feb. 5, 2008

(54) SWITCHING DEVICE

(75) Inventor: Inge Østergaard, Heggedal (NO)

(73) Assignee: Vetco Gray Scandinavia AS, Billingstad (NO)

( * ) Notice: Subject to any disclaimer, the term of this patent is extended or adjusted under 35 U.S.C. 154(b) by 0 days.

(21) Appl. No.: 10/508,855

(22) PCT Filed: Mar. 24, 2003

(86) PCT No.: PCT/IB03/01072

§ 371 (c)(1),
(2), (4) Date: Sep. 24, 2004

(87) PCT Pub. No.: WO03/081728

PCT Pub. Date: Oct. 2, 2003

(65) Prior Publication Data

US 2005/0116799 A1 Jun. 2, 2005

(30) Foreign Application Priority Data

Mar. 25, 2002 (NO) ..... 20021470

(51) Int. Cl.
*H01H 15/00* (2006.01)

(52) U.S. Cl. ..... 200/48 R; 200/1 R; 200/16 R

(58) Field of Classification Search ..... 200/1 R, 200/16 R–16 D, 17 R, 18, 1 V, 11 TC, 50.32, 200/50.33, 537, 547, 549, 550, 48 R–48 CB; 307/64, 86, 29, 38, 112, 125, 126
See application file for complete search history.

(56) References Cited

U.S. PATENT DOCUMENTS 3,673,364 A * 6/1972 Klein ..... 200/16 C
3,772,483 A * 11/1973 Flynn et al. ..... 200/1 R
3,824,355 A * 7/1974 Norman et al. ..... 200/16 F
4,143,254 A * 3/1979 Heyrana ..... 200/16 R
4,562,316 A * 12/1985 Kranich, II ..... 200/16 D
4,644,112 A * 2/1987 Kranich, II ..... 200/16 F
6,162,082 A 12/2000 Karsten et al.
6,849,813 B1 * 2/2005 Albrecht ..... 200/11 TC

FOREIGN PATENT DOCUMENTS

WO WO8404201 A1 10/1984
WO WO9821785 A1 5/1998

* cited by examiner

*Primary Examiner*—Michael A Friedhofer
(74) *Attorney, Agent, or Firm*—Venable LLP; Eric J. Franklin

(57) ABSTRACT

An electrical switching device including at least one ingoing conductor at least a first and a second outgoing conductor, and an arrangement for connecting and disconnecting the conductors by means of an axial movement. The arrangement includes an axially movable element, which is movable between a first and a second position. The device is arranged such that when the axially movable element is in the first position, the ingoing conductor and the first outgoing conductor are electrically connected, and the ingoing conductor and the second outgoing conductor are disconnected. When the axially movable element is in the second position, the ingoing conductor and the first outgoing conductor are disconnected, and the ingoing conductor and the second outgoing conductor are electrically connected.

17 Claims, 3 Drawing Sheets

SWITCHING DEVICE

FIELD OF THE INVENTION

The present invention relates to an electrical switching device having at least one ingoing conductor and at least two outgoing electrical conductors and an arrangement for electrically connecting and disconnecting the conductors by means of an axial movement. A switching device according to the invention can be used in single-phase or multiphase, at medium or high voltage applications, and is suitable for power distribution systems for sub-sea applications as well as land-based applications. As an example of the former, the switching device according to the invention may be used in connection with power supply of sub-sea electrical equipment or apparatus, such as electrical submerged pumps. A typical electrical rating of the switching device is three-phase power through-put in the range of 1-11 kV and 50-500 A.

The present invention further relates to the use of the switching device according to the invention for sub-sea electrical power distribution and routing, in general.

The present invention further relates to a method for alternately connecting and disconnecting at least one ingoing conductor to at least two outgoing electrical conductors.

PRIOR ART

The development within offshore oil and gas exploitation has in the recent years been extended to include sub-sea electrical equipment and installations for production and transportation of oil and gas. These sub-sea installations replace equipment traditionally placed on platforms to which oil and gas were transported for further processing and transportation. This development of sub-sea production, transportation and processing systems have resulted in an increasing need for supply of large quantities of electrical power to sub-sea equipment. The combination of electrical power and conductive sea water, makes coupling of electrical cables to electrical equipment on the sea bottom very difficult and risky. Switching devices, which are developed for use in connection with power supply to sub-sea equipment has to be robust and adapted for remote operation. Essentially, they allow electrical power to be routed to one original drive unit, e.g. an electrical pump, to a second redundant drive unit, during an intermediate shutdown of power.

An example of a switching device intended for use in a sub-sea application, is shown in the international publication WO 98/21785. The switching device shown comprises an ingoing and an outgoing conductor connected to two mutually spaced male parts mounted along a common centerline and a middle-piece provided within the space between the male parts. The middle-piece is provided with two contact elements in the form of two female parts, which can be moved into contact with the respective housings. The movement of the contact elements can be controlled by a remote control system. The conductors are connected by moving the female parts in opposite directions along the common centerline until the female parts are in coupling engagement with the male parts. Accordingly, the conductors are connected and disconnected by means of an axial movement of the contact elements. A disadvantage of this prior art switching device is that it is complicated and comprises several moving parts.

Sub-sea equipment has a high demand on reliability. A problem with sub-sea equipment located at large water depth is the difficulty in getting access to and performing repairs of a defect apparatus. This problem may be solved by outfitting the equipment with two electrical drive units or apparatus, which have been set up in a configuration such that one of them is a spare or redundant apparatus for the other one. If one of the apparatus become defect, the other can be used instead. Thus, a need arises for remotely controlled switching devices, which can disconnect the defect apparatus and connect the functioning apparatus. Such a switching device must be compact, robust, and reliable in order for the device in itself not to introduce risk of failure.

SUMMARY OF THE INVENTION

The object of the present invention is to provide a switching device for alternately connecting and disconnecting at least one ingoing conductor between at least two outgoing conductors, which switching device is robust, reliable, and compact.

This object is achieved by an electrical switching device comprising an ingoing conductor, a first and a second outgoing conductor and an arrangement for connecting and disconnecting the conductors including an axially movable element, said element being movable between a first and a second position. The device is arranged such that when the axially movable element is in the first position, the ingoing conductor and the first outgoing conductor are electrically connected and the ingoing conductor and the second outgoing conductor are disconnected, and when the axially movable element is in the second position, the ingoing conductor and the first outgoing conductor are disconnected and the ingoing conductor and the second outgoing conductor are electrically connected. The connection and disconnection of the conductors are achieved by moving one single element between two positions, i.e. the device has only one moving electrical component and is thus robust and reliable and can be made compact.

According to an embodiment of the invention, the ingoing conductor is connected to the first outgoing conductor via a first middle-piece having an electrically insulating portion, the ingoing conductor is connected to the second outgoing conductor via a second middle-piece having an electrically insulating portion, and said insulating portions are axially displaced relative to each other. Preferably, each of said middle-pieces comprises conducting portions arranged on opposite sides of the insulating portion. Thanks to the axial displacement between the insulating portions and between the conducting portions it is possible to disconnect and connect the conductors by axially moving the element between two positions. The switching device also functions as a disconnector and the insulating portions provide a physical distance between the conducting parts when the conductors are disconnected.

According to a further embodiment of the invention, the axially movable element comprises a first and a second contact member, preferably in the form of a sleeve. The axial position of the contact members relative to said insulating portions determines whether the ingoing conductor is electrically connected or disconnected to the first or second outgoing conductor. By one axial movement, the electrical connection between the ingoing conductor and the first outgoing conductor is cut and a new connection is established between the ingoing conductor and the second outgoing conductor.

According to a further embodiment of the invention, the first and the second contact member are essentially tubular, preferably having contact points or lamellas recessed in radial pockets at each end of said contact member. The longitudinal axis of the first contact member and the longitudinal axis of the first middle-piece are arranged coaxially, and that the longitudinal axis of the second contact member and the longitudinal axis of the second middle-piece are arranged coaxially. By this arrangement, large contact areas between the contact member and the conducting portions of the middle-piece are obtained. The tubular shape of the contact member, functioning as a guide, makes it stable during the movement preventing it also from rotating.

According to a further embodiment of the invention, the ingoing conductor comprises a first conductor element linearly displaced relative to the first outgoing conductor and a second conductor element linearly displaced relative to the second outgoing conductor and that said middle-pieces are provided within the space between the conductor elements and the outgoing conductors.

According to a further embodiment of the invention, the first in-going conductor is adapted for providing electrical power of a first phase, the device comprises a second ingoing conductor adapted for providing electrical power of a second phase, a third and a fourth outgoing conductor, and the device is arranged such that when the axially movable element is in the first position, the second ingoing conductor and the third outgoing conductor are connected and the second ingoing conductor and the fourth outgoing conductor are disconnected and when the axially movable element is in the second position, the second ingoing conductor and the third outgoing conductor are disconnected and the second ingoing conductor and the fourth outgoing conductor are connected. Thus, the same axial moveable element can be used for connection and disconnection of electrical power supplied by a plurality of conductors representing two or more phases.

According to a further embodiment of the invention, said arrangement comprises an actuator for hydraulically moving said axially movable element. A hydraulic actuator can easily be remotely operated, by means of an industrial standard power- or process control system.

According to a further embodiment of the invention, the first and the second outgoing conductor are adapted for being alternately connected to a first and a second electrical unit, where the one unit is redundant to the other, and that the conductors are adapted for supplying power to the circuits. The switching device is particularly suitable for switching between two above-mentioned units.

According to a further embodiment of the invention, the switching device is arranged submerged within a dielectric medium. Preferably said dielectric medium is a mineral or synthetic oil, such as a transformer oil or similar. By arranging the switching device submerged in a dielectric medium, it is avoided that salt water comes into contact with crucial, conducting parts of the device. Thus, the switching device is particularly suitable for sub-sea electrical power distribution. For facilitating the movement of the element in the medium, the movable element is provided with at least one passage for transportation of said dielectric medium through the movable element. During the movement of the element, the surrounding medium is compressed and thanks to a through-hole, the medium will find a flow path through the element to the other side of the element, hence equalizing the change in displacements.

A further object of the invention is to provide a method for connecting and disconnecting at least one ingoing conductor and at least two outgoing electrical conductors. This object is achieved by moving an axially movable element from a first position to a second position, thereby disconnecting the ingoing conductor and the first outgoing conductor and connecting the ingoing conductor and the second outgoing conductor, and moving the axially movable element from the second position to the first position, thereby disconnecting the ingoing conductor and the second outgoing conductor and connecting the ingoing conductor and the first outgoing conductor.

BRIEF DESCRIPTION OF THE DRAWINGS

The invention will now be explained more closely by the description of different embodiments thereof and with reference to the appended figures.

DETAILED DESCRIPTION OF PREFERRED EMBODIMENTS OF THE INVENTION

Figure 1:
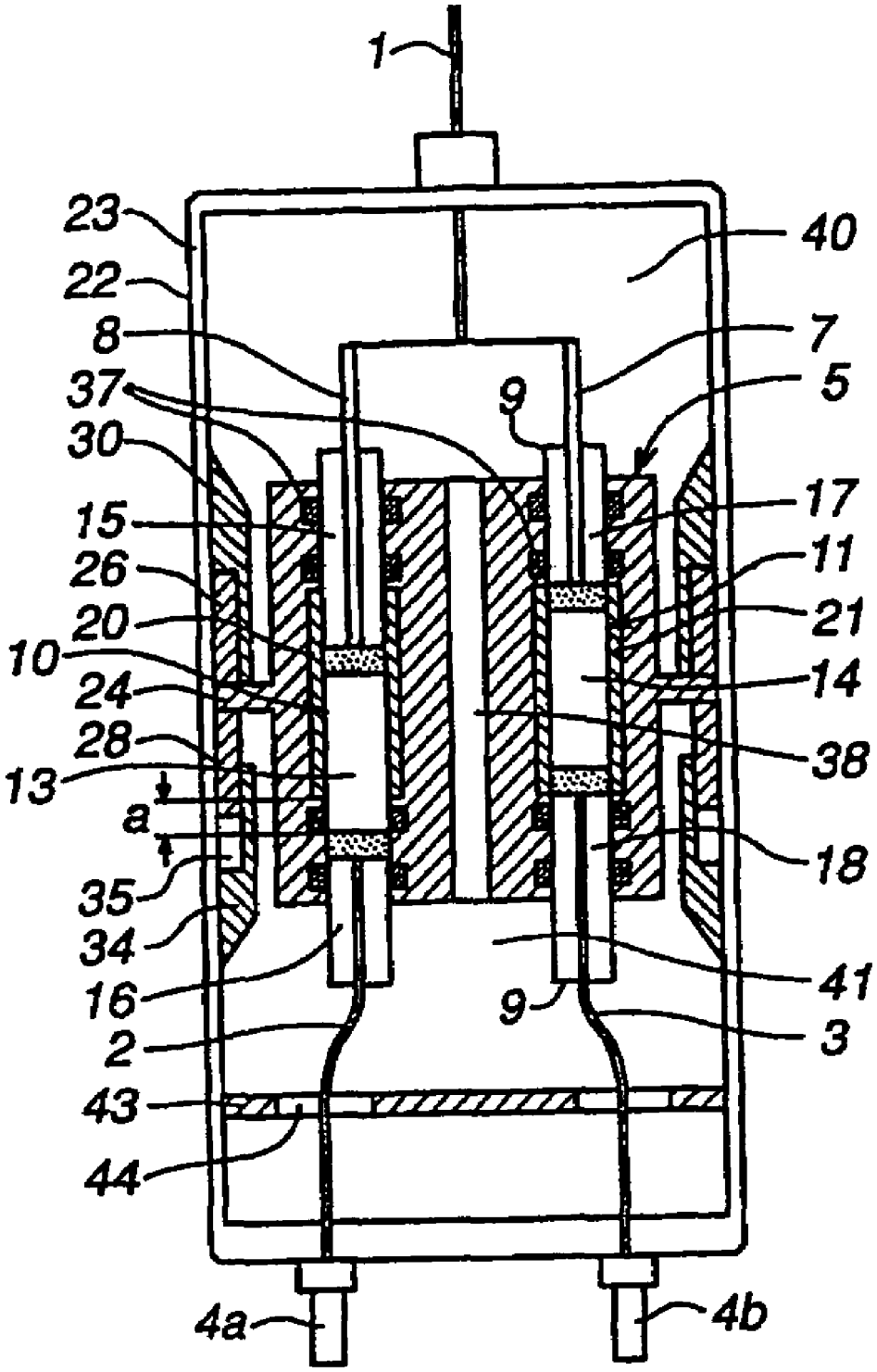
FIG. 1 shows a longitudinal cross-section of a switching device according to a second embodiment of the invention where the movable element is in a first position (right side set of conductors connected).
Figure 2:
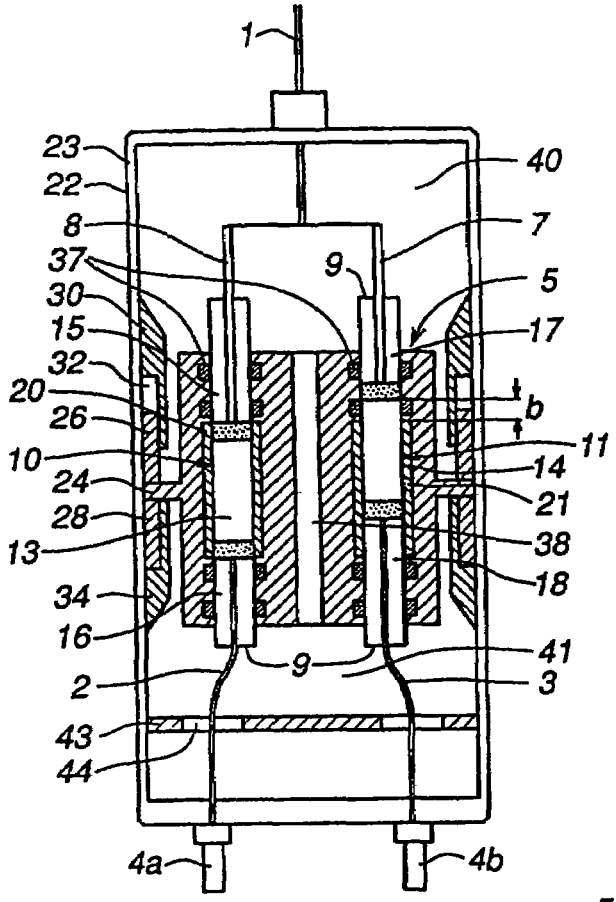
FIG. 2 shows the switching device in FIG. 1, where the movable element is in a first position (left side set of conductors connected).

FIGS. 1 and 2 show a vertical cross-section through a switching device according to a first embodiment of the invention comprising an ingoing conductor 1, a first outgoing conductor 2, and a second outgoing conductor 3. The ingoing conductor 1 is adapted for receiving electrical power from a power source and the outgoing conductors 2, 3 are adapted for supplying electrical power to two separate contacts 4*a*, 4*b*. The contacts 4*a*, 4*b* can for instance be connected to drive units or apparatus, where the one unit is redundant to the other. The switching device according to the invention operates in two states. In the first state, power is supplied via the first contact 4*a* and in the second state, power is supplied via the second contact 4*b*. The switching device never turns off the power, but only switches it between the two contacts 4*a*, 4*b*.

The switching device further comprises an axially moveable element 5. The element 5 is moveable along an axis through the switching device. The element 5 shown in FIGS. 1 and 2 is movable along a vertical axis. However, the axis may have any other direction. The switching of power between the two contacts 4*a*, 4*b* is performed by moving the moveable element 5 between two axial positions. FIG. 1 shows the switching device with the moveable element in the first position. The ingoing conductor 1 is connected to a first and a second conductor element 7, 8. The conductor elements 7, 8 are formed by two mutually parallel pins. The conductor elements 7, 8 and the outgoing conductors 2, 3 are linearly displaced relative to each other and middle-pieces 10, 11 are provided in the space between them.

The middle-pieces have an essentially cylindrical shape and one end thereof is connected to the conductor elements 7, 8 and the other end is connected to the outgoing conductors 2, 3. The middle-pieces comprise a number of electrically conducting portions 15, 16, 17, 18 and non-conducting portions 13, 14, stacked on each other in an axial direction. The conducting and non-conducting portions are essentially cylindrical. The first middle-piece comprises one non-conducting portion 13 and the second middle-piece comprises one non-conducting portion 14, and the non-conducting portions 13, 14 are axially displaced relative to each other. Each of the middle-pieces comprises two conducting portions 15, 16 and 17, 18 arranged on opposite sides of the isolating portions 13,14.

The axially moveable element 5 comprises a first and a second contact member 20, 21 both essentially tubular, having contact points or lamellas recessed in radial pockets at each end of said contact member. The first and the second contact member 20, 21 are arranged with their longitudinal axis parallel to the direction of the movement. The first contact member 20 and the first middle-piece 10 are arranged co-axially with the first contact member 20 surrounding the first middle-piece 10. In the same manner, the second contact member 21 and the second middle-piece 11 are arranged co-axially with the second contact member 21 surrounding the second middle-piece 11.

During the movement of the moveable element 5, the contact members 20, 21 are moved along the middle-pieces 10, 11. Depending on the position of the moveable element 5, and thereby the position of the contact members 20, 21, relative to the non-conducting portions 13, 14 and conducting portions 15, 16, 17, 18 of the middle-pieces, electrical connection is established or broken between ingoing conductor 1 and outgoing conductors 2 and 3. FIG. 1 shows a moveable element 5 in a first upper position and FIG. 2 shows the moveable element in a second, and lower position. When the moveable element is in the upper position, the contact member 20 is in contact with the upper conducting portion 15 of the middle-piece 10, but the contact member 20 is not in contact with the lower conducting portion 16, since the contact member 20 is located above the lower conducting portion 16. The upper and the lower conducting portions 15, 16 are separated by the non-conducting portion 13. Since there is a considerable distance, shown by "a" in FIG. 1, between the first contact member 20 and the lower conducting portion 16, no current can pass between the conductor element 8 and the outgoing conductor 2. Therefore, when the moveable element 5 is in its upper position, the ingoing conductor 1 and the outgoing conductor 2 are disconnected.

As shown in FIG. 1, the second contact member 21 is in contact with both the upper conducting portion 17 and the lower conducting portion 18 of the middle-piece 11 when the moveable element is in its upper position. Accordingly, current can pass from the conductor element 7, via the upper conducting portion 17, the contact member 21, and the lower conducting portion 18 to the second outgoing conductor 3. Therefore, when the moveable element 5 is in its upper position, the ingoing conductor 1 is connected to the outgoing conductor 3.

FIG. 2 shows the moveable element 5 in a second, lower position. In the lower position, the contact member 20 is in electrical contact with both the upper conducting portion 15 and the lower conducting portion 16 of the first middle-piece 10. Accordingly, the ingoing conductor 1 is electrically connected to the first out-going conductor 2 via the contact element 8, the upper conducting portion 15, the contact member 20, and the lower conducting portion 16. Therefore, when the moveable element 5 is in its lower position, the ingoing conductor 1 is connected to the out-going conductor 2.

When the moveable element 5 is in its lower position, the second contact member 21 is located below the upper conducting portion 17 and is displaced therefrom a distance as shown by "b" in FIG. 2. Accordingly, the current cannot pass from the upper conducting portion 17 to the second contact member 21. Therefore, when the moveable element 5 is in its lower position, the ingoing conductor 1 and the outgoing conductor 3 are disconnected.

The switching device comprises a tubular housing 22. The ingoing conductor 1 is arranged in the upper part of the housing and the outgoing conductors 2, 3 are arranged in the lower part of the housing 22. The moveable element 5 includes an essentially cylindrically shaped body of an insulating material. The body of the moveable element 5 comprises a flange 24, which extends radially and having bearing against the housing 22. On opposite sides of the flange 24, an upper 26 and a lower 28 ring-shaped actuator element are arranged. The housing 22 comprises a tubular wall 23. The wall 23 comprises an inwardly and downwardly extending portion 30, which together with the wall 23 defines an upper volume 32 (see FIG. 2) adapted for receiving the upper ring-shaped actuator element 26, when the moveable element 5 is moved into the upper position. In the same manner, an inwardly and upwardly extending wall portion 34 is arranged so that it, together with the wall 23, defines a lower volume 35 (see FIG. 1), which is adapted for receiving the lower ring-shaped actuator element 28, when the moveable element 5 is moved to its lower position.

The upper 32 and the lower volume 35 are filled with a fluid, such as air or oil. Each of the volumes 32, 35 is connected to a hydraulic means (not shown in the figures), which can change the pressure in the fluid. The moveable element 5 is pushed downwards by increasing the pressure in the fluid in the upper volume 32, ventilating the fluid in the lower volume 35, thereby forcing the upper actuator element 26 against the flange 24 and thus pushing the moveable element 5 downwards. In the same manner, the moveable element 5 is pushed upwards by increasing the pressure in the lower volume 35, ventilating the fluid in the upper volume 32, thereby forcing the lower actuator element 28 against the flange 24 and thus moving the moveable element 5 upwards.

The housing 22 is divided by the moveable element 5 into an upper room 40 and a lower room 41. The upper and the lower room 40, 41 are filled with a liquid, such as dielectric oil, for the purpose of providing additional electrical insulation between the electrical components inside 22. The housing 22 is sealed relative to the surrounding environment outside 22. The moveable element 5 is provided with at least one passage 38 for transportation of the dielectric oil between the upper and the lower room 40, 41 during movement of the moveable element 5.

Figure 3:
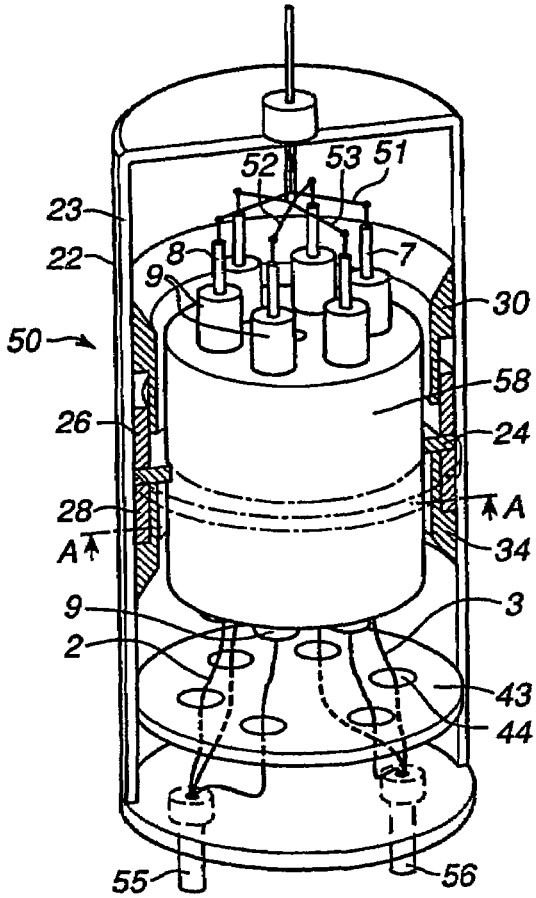
FIG. 3 shows a perspective partly sectional view of a second embodiment of the switching device according to the invention, which is adapted for switching power of three phases.

For the purpose of avoiding contact between the conducting portions 15, 16 and the surrounding dielectric oil, the conductor elements 7, 8 and the outgoing conductors 2, 3 are provided with electrical insulators 9, and the moveable element 5 is provided with a number of electrical sealing elements 37 in the form of electrical gland seals. Another purpose of the gland seals is to avoid electrical short-circuiting between electrically conducting portions of different phases, if the switching device is adapted for switching power of more than one phase, as shown in FIG. 3. An electrical gland seal preferably comprises a soft polymer cylindrical ring having typically a small tapered hole in the center. The inner diameter of the ring is such that it will experience a radial squeeze as the middle piece enters and runs onto the ring. The radial compression and the ability to wipe clean the middle piece are the main requirements in order to seal off electrical breakthrough in the loaded interface between the gland seal and the middle piece.

The ring-shaped gland seals 37 are arranged around the first and the second middle-pieces 10, 11. More particular, the axially movable element 5 comprises at least four gland seals 37 arranged on opposite sides of the first and the second contact member. Since the contact elements are moved between two different positions, each side of the contact members is preferably provided with two mutually displaced isolating gland seals 37, corresponding to the first and the second position of the moveable element 5.

The switching device is also provided with a pressure barrier 43 arranged in the lower part of the housing 22. The pressure barrier 43 comprises electrical penetrators 44 in the form of glass plugs adapted for receiving the first and the second outgoing conductors 2, 3. Such a pressure barrier is particularly suitable in a sub-sea application and is provided in order to increase the reliability of the seal around conductors 2 and 3 and in particular to withstand pressure differences across this barrier 43. The switching device shown in FIGS. 1 and 2 is adapted for supplying power and switching the power between a first and a second electrical circuit connected to the first and the second contact 4*a*, 4*b*. Each of the electrical circuits preferably comprises a redundant apparatus, such as an electrical drive (motor) typically.

Figure 4:
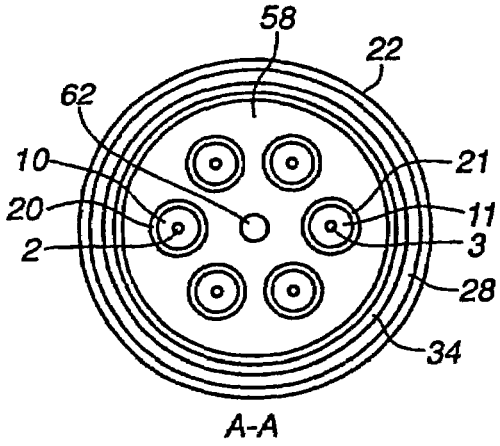
FIG. 4 shows a cross-section of the switching device in FIG. 3 along the line A-A.

FIGS. 3 and 4 show a switching device 50 of a second embodiment, which is suitable for providing power having three phases. The switching device 50 comprises a first ingoing conductor 51 adapted for providing electrical power of a first phase, a second ingoing conductor 52 adapted for providing electrical power of a second phase, and a third ingoing conductor 53 adapted for providing electrical power of a third phase. In the same manner as in the previously described embodiment, each of the conductors is connected to a first and a second conductor element 7, 8. The switching device comprises six outgoing conductors, three of them connected to a first socket 55 and three of them connected to a second 56 socket outlet adapted for providing 3-phase power to an electric circuit connected to each of the sockets.

In the same manner as in the previous embodiment, middle-pieces are provided in the space between the conductor elements and the outgoing conductors, and an axially moveable element 58 is arranged moveable along an axis parallel with the longitudinal axis of the middle-pieces. The moveable element 58 is provided with six vertically arranged openings adapted for receiving the middle-pieces. The openings are circularly arranged about the centerline of the moveable element. The moveable element 58 is provided with a passage 62 going through the moveable element in the vertical direction. The passage 62 is adapted for transportation of a dielectric fluid between the lower and the upper part of the housing during movement of the moveable element 58. The switching device shown in FIGS. 3 and 4 works in the same way as the switching device shown in FIGS. 1 and 2, except for the fact that the switching device shown in FIGS. 3 and 4 is providing 3-phase power and the switching device shown in FIGS. 1, 2 provides 1-phase power.

Figure 5:
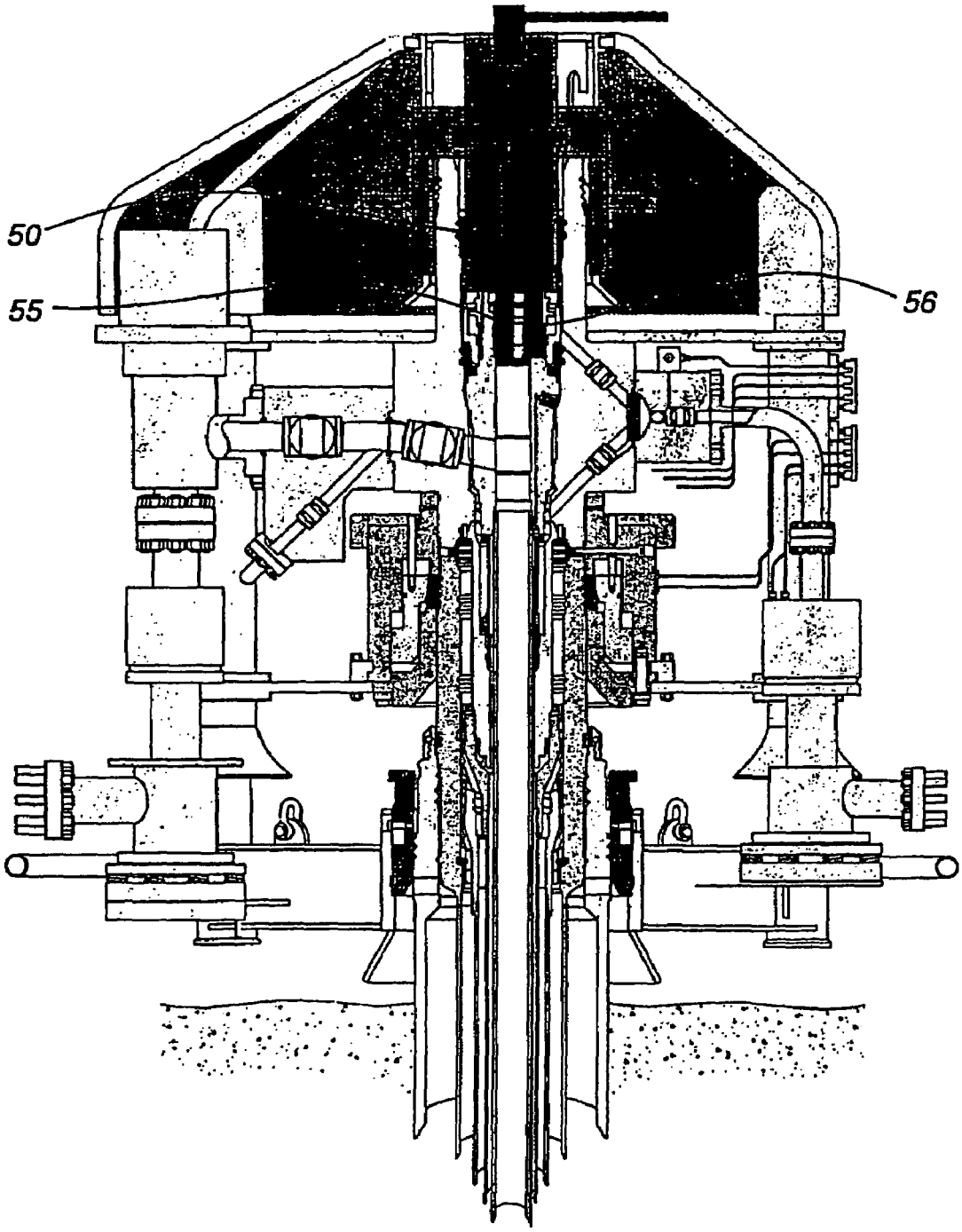
FIG. 5 shows schematically a switching device according to the invention at a location inside the top of a sub-sea valve-tree.

The switching device according to the first and the second embodiments is particularly suitable for the use in sub-sea applications involving power distribution systems with poor or practically no access for repairs. FIG. 5 shows the switching device 50 installed in the upper part of a horizontal valve-tree intended for use typically as the termination of a subsea well completion system. The first socket outlet 55 is connected to a power cable feeding electrical power to a first electrical submerged pump (ESP), which is not shown in the figure. The second socket outlet 56 is electrically connected to the second electrical submerged pump that is redundant due to the first pump. The purpose of the switching device 50 is to switch power from the first pump to the second pump, should the first pump stop working. The switching operation must be performed when the power is temporarily, i.e. only for a short moment, turned off and the conductors are dead, hence the device is not what is referred to as a "power switch". When the switching device has performed the switching operation the power can be turned on again.

The switching device according to the invention can be made very compact and thus may be built into a horizontal valve-tree pressure cap, as shown on FIG. 5. The switching device also allows immediate activation of the redundant second pump, as described above by way of example, and thus considerably saves intervention time.

The present invention is not limited to the embodiments disclosed but may be varied and modified within the scope of the following claims.

The invention claimed is:

1. An electrical switching device comprising an ingoing;

an outgoing conductor;

an arrangement for connecting and disconnecting the conductors by means of an axial movement, said arrangement comprising an axially movable element, said element being movable between a first and a second position; and a second outgoing conductor, wherein the device is arranged such that when the axially movable element is in the first position, the ingoing conductor and the first outgoing conductor are electrically connected and the ingoing conductor and the second outgoing conductor are disconnected, and when the axially movable element is in the second position, the ingoing conductor and the first outgoing conductor are disconnected and the ingoing conductor and the second outgoing conductor are electrically connected, and wherein the device is arranged submerged in a dielectric medium.

2. The electrical switching device according to claim 1, wherein the ingoing conductor is connected to the first outgoing conductor via a first middle-piece having an electrically insulating portion, wherein the ingoing conductor is connected to the second outgoing conductor via a second middle-piece having an electrically insulating portion, and wherein said insulating portions are axially displaced relative to each other.

3. The electrical switching device according to claim 2, wherein the axially movable element comprises a first and a second contact member, and wherein the axial position of the contact members relative to said insulating portions determines whether the ingoing conductor is electrically connected or disconnected to the first or second outgoing conductor.

4. The electrical switching device according to claim 3, wherein the axially movable element comprises at least four gland seals arranged on opposite sides of the first and the second contact member.

5. The electrical switching device according to claim 3, wherein the first and the second contact member are essentially tubular, wherein the longitudinal axis of the first contact member and the longitudinal axis of the first middle-piece are arranged coaxially, and wherein the longitudinal axis of the second contact member and the longitudinal axis of second middle-piece are arranged coaxially.

6. The electrical switching device according to claim 2, wherein the ingoing conductor comprises a first conductor element linearly displaced relative to the first outgoing conductor and a second conductor element linearly displaced relative to the second outgoing conductor and wherein said middle-pieces are provided within the space between the conductor elements and the outgoing conductors.

7. The electrical switching device according to claim 1, wherein each of said middle-pieces comprises conducting portions arranged on opposite sides of each insulating portion.

8. The electrical switching device according to claim 1, wherein the first ingoing conductor is adapted for providing electrical power of a first phase, the device further comprising:

a second ingoing conductor adapted for providing electrical power of a second phase, a third, and a fourth outgoing conductor, wherein the device is arranged such that when the axially movable element is in the first position, the second ingoing conductor and the third outgoing conductor are connected and the second ingoing conductor and the fourth outgoing conductor are disconnected and when the axially movable element is in the second position, the second ingoing conductor and the third outgoing conductor are disconnected and the second ingoing conductor and the fourth outgoing conductor are connected.

9. The electrical switching device according to claim 8, further comprising:

a third ingoing conductor adapted for providing electrical power of a third phase, a fifth, and a sixth outgoing conductor, wherein the device is arranged such that when the axially movable element is in the first position, the third ingoing conductor and the fifth outgoing conductor are connected and the third ingoing conductor and the sixth outgoing conductor are disconnected and when the axially movable element is in the second position, the third ingoing conductor and the fifth outgoing conductor are disconnected and the third ingoing conductor and the sixth outgoing conductor are connected.

10. The electrical switching device according to claim 1, wherein said arrangement comprises an actuator element for hydraulically moving said axially movable element.

11. The electrical switching device according to claim 1, wherein the first and the second outgoing conductor are adapted for being alternately connected to a first and a second electrical unit, which units are redundant, and wherein the conductors are adapted for supplying power to the circuits.

12. The electrical switching device according to claim 1, wherein said dielectric medium is an isolating mineral or synthetic oil.

13. The electrical switching device according to claim 1, wherein the movable element is provided with at least one passage for transportation of said dielectric medium through the movable element.

14. Use of a device according to claim 1 for sub-sea electrical power distribution applications.

15. A method for connecting and disconnecting at least one ingoing conductor and at least two outgoing electrical conductors, comprising:

submerging the at least one ingoing conductor and the at least two outgoing electrical conductors in a dielectric medium, moving an axially movable element from a first position to a second position, thereby disconnecting the ingoing conductor and the first outgoing conductor and connecting the ingoing conductor and the second outgoing conductor, and moving the axially movable element from the second position to the first position, thereby disconnecting the ingoing conductor and the second outgoing conductor and connecting the ingoing conductor and the first outgoing conductor.

16. The method according to claim 15, whereby electrical power of a first phase is provided by the first ingoing conductor, electrical power of a second phase being provided by a second ingoing conductor, and during said movement of said element from the first position to the second position, the second ingoing conductor and a third outgoing conductor are disconnected and the second ingoing conductor and a fourth outgoing conductor are connected, and during said movement of said element from the second position to the first position, the second ingoing conductor and the third outgoing conductor are connected and the second ingoing conductor and the fourth outgoing conductor are disconnected.

17. The method according to claim 16, whereby electrical power of a third phase being provided by a third ingoing conductor, and during said movement of said element from the first position to the second position, the third ingoing conductor and a fifth outgoing conductor are disconnected and the third ingoing conductor and a sixth outgoing conductor are connected, and during said movement of said element from the second position to the first position, the third ingoing conductor and the fifth outgoing conductor are connected and the third ingoing conductor and the sixth outgoing conductor are disconnected.

* * * * *